US009212552B2

(12) United States Patent
Hartwig et al.

(10) Patent No.: US 9,212,552 B2
(45) Date of Patent: Dec. 15, 2015

(54) DEVICE AND METHOD FOR DRIVING TUNNELS, GALLERIES OR THE LIKE

(75) Inventors: Sverker Hartwig, Täby (SE); Kaj Emanuelsson, Viken (SE); Jerk Back, Nacka (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

(21) Appl. No.: 13/261,817

(22) PCT Filed: Aug. 30, 2012

(86) PCT No.: PCT/SE2012/050924

§ 371 (c)(1),
(2), (4) Date: Feb. 20, 2014

(87) PCT Pub. No.: WO2013/048306

PCT Pub. Date: Apr. 4, 2013

(65) Prior Publication Data

US 2015/0152728 A1 Jun. 4, 2015

(30) Foreign Application Priority Data

Sep. 27, 2011 (SE) ..... 1100713-5

(51) Int. Cl.

| | |
|---|---|
| ***E21D 9/10*** | (2006.01) |
| ***E21C 27/24*** | (2006.01) |
| ***E21C 29/02*** | (2006.01) |
| ***E21D 9/11*** | (2006.01) |

(52) U.S. Cl.

CPC ..... *E21C 29/02* (2013.01); *E21C 27/24* (2013.01); *E21D 9/102* (2013.01); *E21D 9/1006* (2013.01); *E21D 9/1013* (2013.01); *E21D 9/1093* (2013.01); *E21D 9/112* (2013.01)

(58) Field of Classification Search

CPC ..... E21D 9/102; E21D 9/1026; E21D 9/1013; E21C 27/24

USPC ..... 299/74, 75, 77

See application file for complete search history.

(56) References Cited

U.S. PATENT DOCUMENTS

| | | | | |
|---|---|---|---|---|
| 981,201 | A * | 1/1911 | Kuhn | 299/10 |
| 2,659,585 | A * | 11/1953 | McCallum | 299/75 |

(Continued)

FOREIGN PATENT DOCUMENTS

| | | |
|---|---|---|
| AT | 506501 | 9/2009 |
| AU | 659378 | 5/1993 |

(Continued)

*Primary Examiner* — David Bagnell
*Assistant Examiner* — Michael Goodwin
(74) *Attorney, Agent, or Firm* — Mark P. Stone

(57) ABSTRACT

A device (1) for driving tunnels, galleries or the like including a cutting head (2), wherein an excavating direction of the cutting head (2) being essentially at a right angle to said rotation axis (R), a base unit (3) with stabilizing units (S1, S2, S3, S4) for applying and fixing against rock surfaces, a support unit (4) for the cutting head (2), a joint device (5) for pivotal connection of the support unit to the base unit, forcing means (6,7,8,9) arranged between the base unit and the support unit for swinging the cutting head. The joint device (5) is arranged for vertical as well as for horizontal swinging of the support unit (4) in respect of the base unit (3), wherein the support unit (4) is vertically as well as horizontally swingable by means of a pair of upper fluid cylinders (6,7) and a pair of lower fluid cylinders (8,9) comprising said forcing means.

20 Claims, 5 Drawing Sheets

(56) References Cited

U.S. PATENT DOCUMENTS

| | | | | |
|---|---|---|---|---|
| 2,801,092 | A * | 7/1957 | Joy | 299/55 |
| 3,506,310 | A | 4/1970 | Gruere | |
| 3,860,292 | A | 1/1975 | Bechem | |
| 4,045,088 | A * | 8/1977 | Bechem | 299/31 |
| 4,371,210 | A | 2/1983 | Leibee | |
| 4,486,050 | A | 12/1984 | Snyder | |
| 4,548,442 | A | 10/1985 | Sugden et al. | |
| 4,629,010 | A | 12/1986 | Source | |
| 4,646,853 | A | 3/1987 | Sugden et al. | |
| 4,721,340 | A | 1/1988 | Wrulich et al. | |
| 5,035,071 | A | 7/1991 | Stotzer et al. | |
| 5,192,115 | A | 3/1993 | Hartman et al. | |
| 5,333,937 | A | 8/1994 | Hopkins | |
| 5,964,305 | A | 10/1999 | Arzberger et al. | |
| 6,578,926 | B2 | 6/2003 | Bandy, Jr. et al. | |
| 8,690,262 | B2 * | 4/2014 | Ebner et al. | 299/75 |
| 2004/0124691 | A1 | 7/2004 | Ehler et al. | |
| 2009/0322142 | A1 | 12/2009 | Lever et al. | |
| 2011/0198914 | A1 * | 8/2011 | Hartwig et al. | 299/18 |

FOREIGN PATENT DOCUMENTS

| | | | |
|---|---|---|---|
| CH | 677953 | A5 | 7/1991 |
| EP | 0349610 | A | 1/1990 |
| EP | 1437445 | A1 | 7/2004 |
| GB | 801615 | | 9/1958 |
| JP | 10176478 | A | 6/1998 |
| WO | WO 89/05391 | | 6/1989 |
| WO | WO 93/07359 | | 4/1993 |
| WO | WO 2009/100469 | | 8/2009 |
| WO | WO 2010/050872 | | 5/2010 |
| WO | WO 2011/093777 | | 8/2011 |

* cited by examiner

DEVICE AND METHOD FOR DRIVING TUNNELS, GALLERIES OR THE LIKE

FIELD OF THE INVENTION

The invention relates to a device for driving tunnels, galleries or the like including a rotatable cutting head which includes a plurality of radial cutting elements and which is arranged to be swung by means of forcing means being arranged between a base unit and a support unit. The invention also concerns a method for driving tunnels, galleries or the like.

BACKGROUND OF THE INVENTION

From WO2010/050872 is previously known a device according to the above, which can be called a mobile mining machine. In the previously known mobile mining machine, a rotatable cutting head, having cutting elements extending radially from a peripheral region of the cutting head, is arranged to be pressed against the rock to be excavated with great force during simultaneous rotation of the cutting head. Rock excavation is performed by disk-shaped cutting elements being brought to form parallel grooves in the rock, whereby material in between is successively chipped or broken away without this material having to be subjected to a direct disintegrating force.

The previously known device works well and the aim of the present invention is to provide a further development thereof, which provides increased flexibility when used under certain mining situations.

AIM AND MOST IMPORTANT FEATURES OF THE INVENTION

This aim is obtained in a device defined above in that the joint device is arranged for vertical as well as for horizontal swinging of the support unit in respect of the base unit, wherein the support unit is vertically as well as horizontally swingable and is able to be pressed in said excavating direction by means of a pair of upper fluid cylinders and a pair of lower fluid cylinders comprising said forcing means, and that the support unit is supported by the base unit in such a way that during vertical swinging, the rotation axis can be angled in a vertical symmetry plane extending through the support unit and the joint device.

In particular this verticals symmetry plane includes the rotation axis of the cutting head as well as the pivot axis of the joint device.

The support unit is thereby essentially non-rotational in respect of the base unit around an imagined axis through the joint device and a centre of the cutting head.

Through these features, a device is provided which is given the possibility of being arranged for driving particularly low tunnels and galleries in an effective and time-saving manner. By having the cutting head, during operation, being arranged with its rotation axis angularly adjustable in said vertical symmetry plane, that is from a vertical position being angled "upwards" and "downwards" as seen from the base unit and angled sideways in both directions, the possibility is achieved to flexibly form tunnels and galleries having narrow dimensions compared to the device for driving.

The cutting head, which is used in devices according to the invention, is wheel-shaped and includes inside rotation motor means for its rotation. During working, the cutting head rotates continuously with a chosen rotational speed.

Tunnels and galleries can be formed having width and height dimensions from only marginally exceeding a cross section of a device for tunnelling to considerably exceeding such dimensions.

Through the construction of the forcing means to include a pair of upper fluid cylinders and a pair of lower fluid cylinders it is possible, in a space saving and effective manner, to perform pushing or pressing of the cutting head into the rock to be excavated, accomplish and set a vertical position of the cutting head for excavating and provide swing movements for the cutting head for excavating and for repositioning of the cutting head.

It shall be noted that in this text "vertical" means a vertical direction of the device for driving according to the invention in a position on a completely horizontal ground. The person skilled in the art understands that the conditions inside a mine deviate from such an ideal state and "vertical" thus concerns direction and plane in relation to the device itself.

It is preferred that each pair of fluid cylinders includes a first fluid cylinder at the first side of the base unit and a second fluid cylinder at a second side of the base unit. Hereby preferable force distribution is achieved resulting in that manoeuvring of the support unit and thereby of the cutting head can be made efficient and with minimized stress.

It is preferred also that each one of said fluid cylinders at a first end is pivotally fastened to a stabilizing unit and at a second end to said support unit. Hereby the force from the fluid cylinders can be effectively led to and be received by means being themselves firmly anchored to rock surfaces. This way it is avoided to subject a frame of the base unit to load, which thereby does not need to be dimensioned for the corresponding force reception.

I.a. for rigidity reasons, the support unit includes a housing-formed construction that covers a backwardly directed portion of the cutting head at an angle of about 100-150° of the periphery of the cutting head. At each side of a position for joining the support unit with said joint device, there are arranged fastening places for pivotal co-operation with the other ends of said fluid cylinders. These fastening places can then be positioned at a great distance from the joint device, which results in good forcing efficiency.

It is also, for corresponding reasons, preferred that the fastening places for pivotal co-operation with the second ends of said fluid cylinders are positioned at as great a distance from each other as is practically possible also in a vertical direction of the support unit.

It is also highly preferred that the stabilizing units are moveably connected to a frame of the base unit. Thereby, on the one hand, they will be able to be re-located in respect of said frame, on the other hand, they will be independent of the movement of the frame during ongoing rock excavation, which is a considerable advantage since the frame is given freedom of movement at the same time as the stabilizing units are firmly attached to the rock and can comprise stable support for the forcing means. These aspects are accentuated in a preferred way by each stabilizing unit being joined to said frame of the base unit through a set of pivotal and length adjustable actuating means.

The stabilizing units include applying means for action upwardly against the roof as well as downwardly against a floor in the form of per se known pressure and force distributing plates.

It is preferred also that the base unit essentially centrally, in the region of said joint device, includes stabilizing means for action upwardly against a roof and/or downwardly against a floor. The purpose of this/these stabilizing means is to provide stabilization of the base unit close to the support unit during excavation. It/they is/are, as a contrast to the stabilizing units, rigidly connected to said frame.

Preferably the support unit, besides being housing-formed, is also constructed in a fork-like manner for support of the cutting head. In particular the support unit is rigidly joined to a shaft, shaft bars or the like that the rotation motor means inside the cutting head is/are arranged to act against.

The base unit exhibits drive units for to and fro driving for displacement between for example different excavating positions.

The cutting head preferably exhibits cutting elements in the form of rotatable cutting disks, which during excavation are brought to produce a plurality of parallel grooves, as is explained above. The cutting head is thus advanced, is swung and is rotated such that the cutting elements roll and cut essentially in the same respective grooves which are successively made deeper, whereby the intermediate material is chipped away etc. according to the above. It is also possible, within the scope of the invention, to provide the cutting head with other types of cutting elements such as for example firmly attached cutting studs which will instead perform a tearing action against the rock to be excavated. It is also possible to make rotatable cutting disks according to the above with peripheral radially extending studs.

The corresponding advantages are achieved in an inventive method through corresponding method features.

BRIEF DESCRIPTION OF DRAWINGS

The invention will now be described in more detail at the background of embodiments and with reference to the annexed drawings, wherein:

FIG. 5 illustrates an alternate embodiment of the shape of the cutting elements of the cutting head.

DESCRIPTION OF EMBODIMENT

Figure 1:
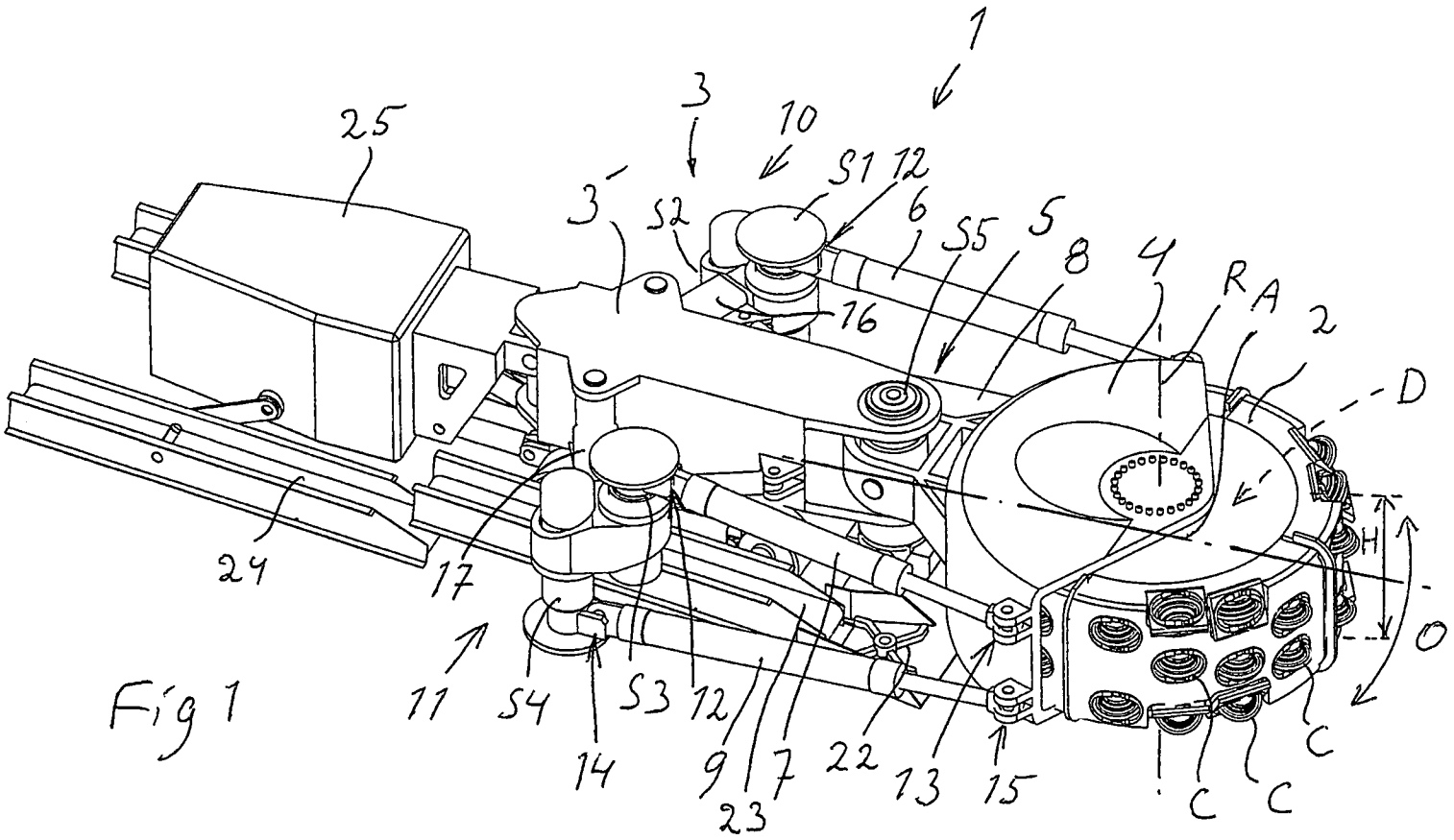
FIGS. 1-4 show a device for driving tunnels, galleries or the like according to the invention in different positions and different perspective views.
Figure 2:
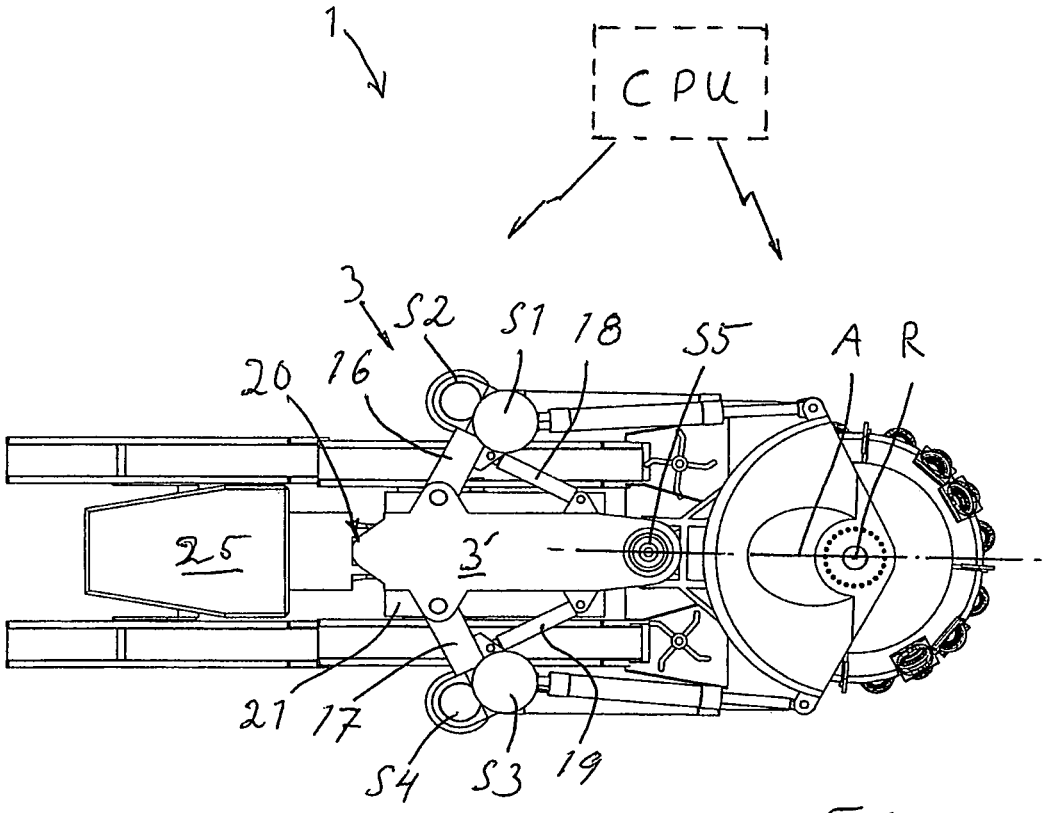

FIGS. 1 and 2 show a device 1 for driving tunnels, galleries or the like having a front region for being applied against rock to be excavated, with a cutting head 2. This cutting head 2 in the shown position comprises vertical rotation axis R. A rotational direction of the cutting head, that is in the direction around its perimeter, is indicated with O and an axial width in an axial direction as seen in the direction of said rotation axis is indicated with H.

Figure 6:
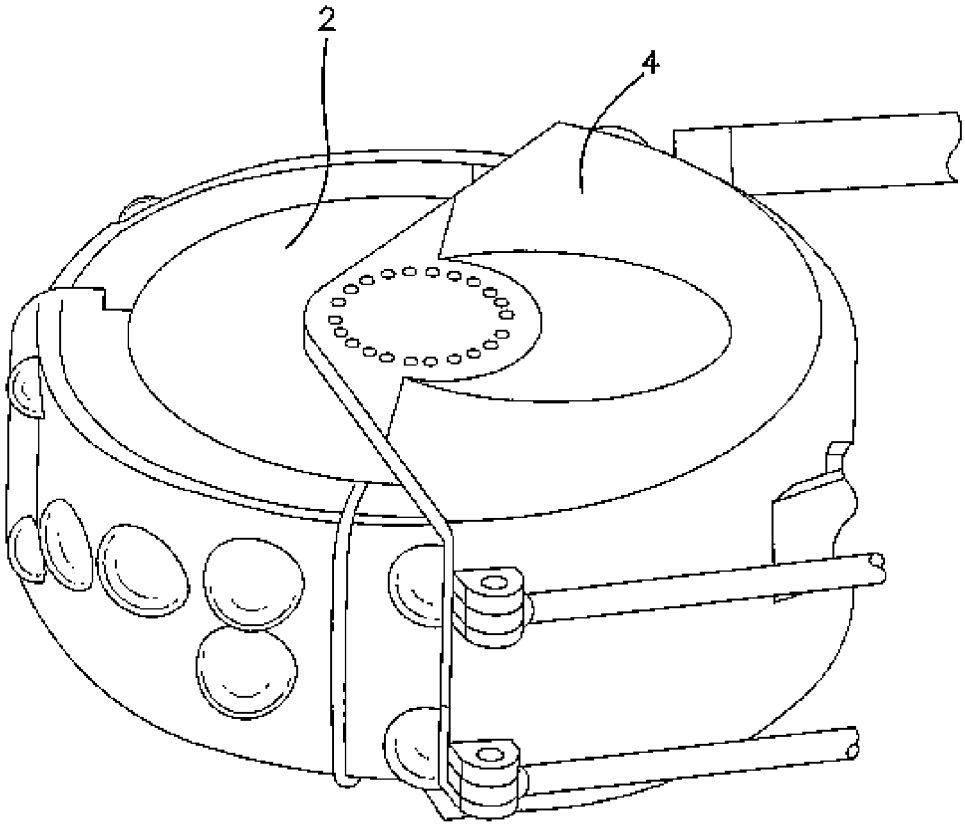

The cutting head 2 in FIGS. 1-4 is provided with a plurality of cutting elements C having disk-shaped cutters distributed in the surrounding direction and over said axial width on its perimeter region in a manner that corresponds to what is discussed above and more closely described in said WO-document. FIG. 6 illustrates cutting elements in the form of cutting studs.

D indicates, with an interrupted line, rotation motor means for rotating the cutting head being inside the cutting head but not shown in the Fig.

The cutting head 2 is supported by a support unit 4, which in a fork-like manner surrounds the cutting head in such a way that it is free in an excavating direction for action against a rock surface, wherein the support unit 4 exhibits a certain width in the sideward direction which has to do with its manoeuvrability.

A base unit, indicated with 3 and having a central frame 3', is at a front end over a joint device 5 connected to the support unit 4. The joint device 5 allows swinging of the support unit 4 and thereby the cutting head 2 in respect of the base unit in side directions as well as upwardly and downwardly relative to the base unit 3.

The support unit is further connected to the base unit in such a way that essentially no relative movement between these elements is possible around an imagined axis A through the joint device and a centre of the cutting head.

For the purpose of swinging, the device exhibits forcing means in the form of a pair of upper fluid cylinders 6 and 7 and a pair of lower fluid cylinders 8 and 9.

The upper pair of fluid cylinders includes a first upper fluid cylinder 6 and a second upper fluid cylinder 7 whereas the lower pair of fluid cylinders includes a first lower fluid cylinder 8 and a second lower fluid cylinder 9. "First" and "second" here refers to positioning to a first side 10 and a second side 11, respectively, of the base unit 3.

The base unit 3 further exhibits upwardly acting stabilising units S1 and S3, which are arranged to be pressed upwardly, against a tunnel roof and downwardly acting stabilising units S2 and S4 arranged to be pressed against a tunnel floor.

As is more clearly shown in FIG. 2, each one of the stabilising units S1, S2 and S3, S4 is connected to the frame 3' of the base unit over a respectively link 16, 17. The links 16 and 17 are lengthwise expandable, for example telescopic, links, which are provided with inside forcing means for the possibility of controlled expansion and contraction. Each one of the stabilizing units S1, S2 and S3, S4 is also connected to the frame 3' of the base unit 3 over a respective power cylinder 18, 19. By means of the links 16 and 17 and the power cylinders 18 and 19, the stabilizing units S1, S2 and S3, S4 can thereby be displaced in respect of the frame 3' of the base unit 3 so that they can be positioned, although inside limits, within a chosen region in respect of said frame of the base unit 3.

The fluid cylinders 6, 7, 8, 9 are pivotally fastened with a respective first end to one of the stabilizing units and with a respective second end to said support unit. The fluid cylinders belonging to the upper pair of fluid cylinders are thereby positioned, seen vertically, at an upper part of the respective stabilizing unit and at an upper part of the support unit, whereas the respective fluid cylinders in the lower pair are attached at a lower part of the respective stabilizing unit and at a lower part of the support unit 4. Hereby is ensured an effective force actuation of the forcing means against the support unit.

The support unit 4 is supported by the base unit 3 in such a manner that during vertical swinging, the rotation axis R is able to be angled within a vertical symmetry plane through the support unit 4 and the joint device 5. From FIG. 2 is in a simple manner understood that this symmetry plane is the vertical plane that Includes the Imagined axis A (that is at a right angle to the plane of the paper) for the section of the device 1 extending from the joint device 5 and including the cutting head 2. As is explained above, this vertical symmetry plane includes the rotation axis R of the cutting head as well as a pivot axis of the joint device 5.

25 indicates a support unit of the device for driving tunnels and galleries, inside which support unit 25 there are positioned the required motors, pumps etc. for the operation of the device. The support unit 25 is connected to the base unit 3 over a second joint device 20. The support unit 25 can be pivoted sideways in respect of the base unit 3. The support unit 25 can also be pivoted in a vertical direction in respect of the base unit 3. The support unit 25 can furthermore be constructed such that it is rigidly joined to the base unit.

A control system is indicated with the reference CPU, and is arranged to be used to control the functions of the device including forward propulsion and swinging of the cutting head by controlled fluid supply to the fluid cylinders, control of the movements of the stabilizing units, the actuation thereof and of the stabilizing means etc.

FIGS. 1 and 2 also show an arrangement for removal of material being excavated and loosened by the cutting head 2, including a capturing plate with a rotation feeder 22 and feed belts 23 and 24. These devices are of a more conventional nature and therefore not further described here.

21 indicates drive units in the form of crawler bands for forward and backward propulsion of the device. Also other kinds of propulsion means can be considered.

In operation of the device, the stabilizing units S1, S2, S3, S4 are typically brought forward in an advanced position in respect of the frame 3' of the base unit 3. Thereupon the stabilizing units are applied very firmly against the floor and roof respectively whereupon the cutting head is set for example in a lower sideward position in respect of the base unit 3. A cutting head is now pressed forward into the rock to be excavated during simultaneous rotation and is this way moved forward in a forward movement with the aid of the fluid cylinders 6, 7, 8, 9 an allowed travel length.

When the cutting head has reached its forward limit where it can no longer be brought forward because of the stroke length of the fluid cylinders, the fluid cylinders 6, 7, 8, 9 will instead be controlled for swinging sideways of the cutting head 2 in the direction of its second determined side position during simultaneous rotation and simultaneous rock excavation as is described above. This will in practice be performed by the cylinders on the one side, against which the cutting head is to be swung, is supplied with fluid for maximal pulling, whereby the pressure forces in the fluid cylinders on the other side can be limited for avoiding the risk of buckling.

When this swing stroke is completed and a lower part of the tunnel as been completed, the support unit (together with the frame 3') and the cutting head is reversed by pulling-in of the fluid cylinders, whereupon the cutting head can be raised to an upper determined level, whereby the cutting head is again positioned in its one determined side position. Thereupon the cutting head is pressed forward during rotation and excavation of rock to its forward extreme position, whereupon side swinging at this higher level will be preformed corresponding to what is described above.

It is to be understood that with the stabilizing units S1, S2 being applied during the forward driving movement of the cutting head 2, also the frame of the base unit 3 will be brought forward since the support unit is non-extendably connected to the base unit. This forward driving movement is allowed for example if the links 16, 17 and the power cylinders 18, 19 are unloaded during the forward driving sequence. They can, however, also be activated but allow relative movements vis-á-vis said frame in order to for example stabilize the frame. During the forward driving phase, the stabilizing unit S3 in the region of the joint device 5 is inactive, whereas it is preferably actuated during the side swinging movement with simultaneous excavation of the cutting head 2.

Figure 3:
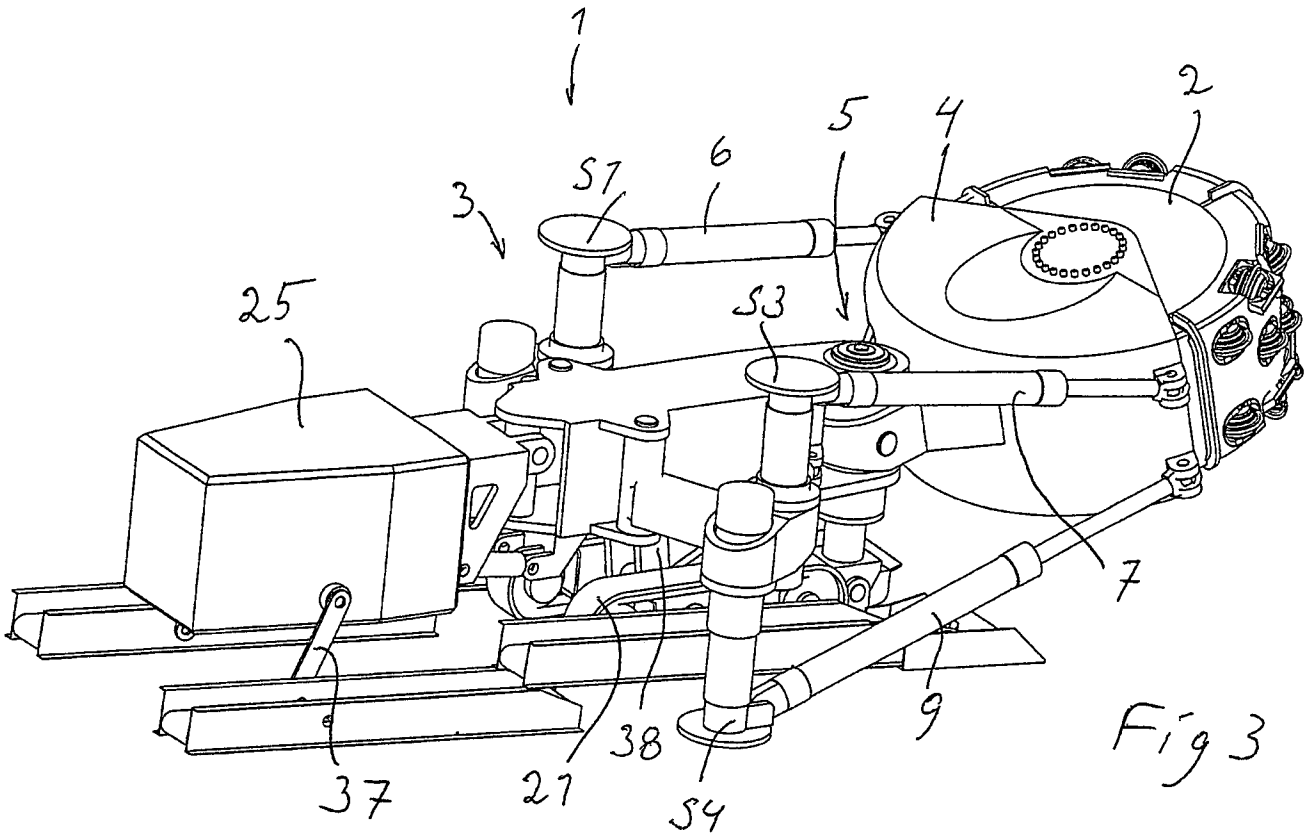
Figure 4:
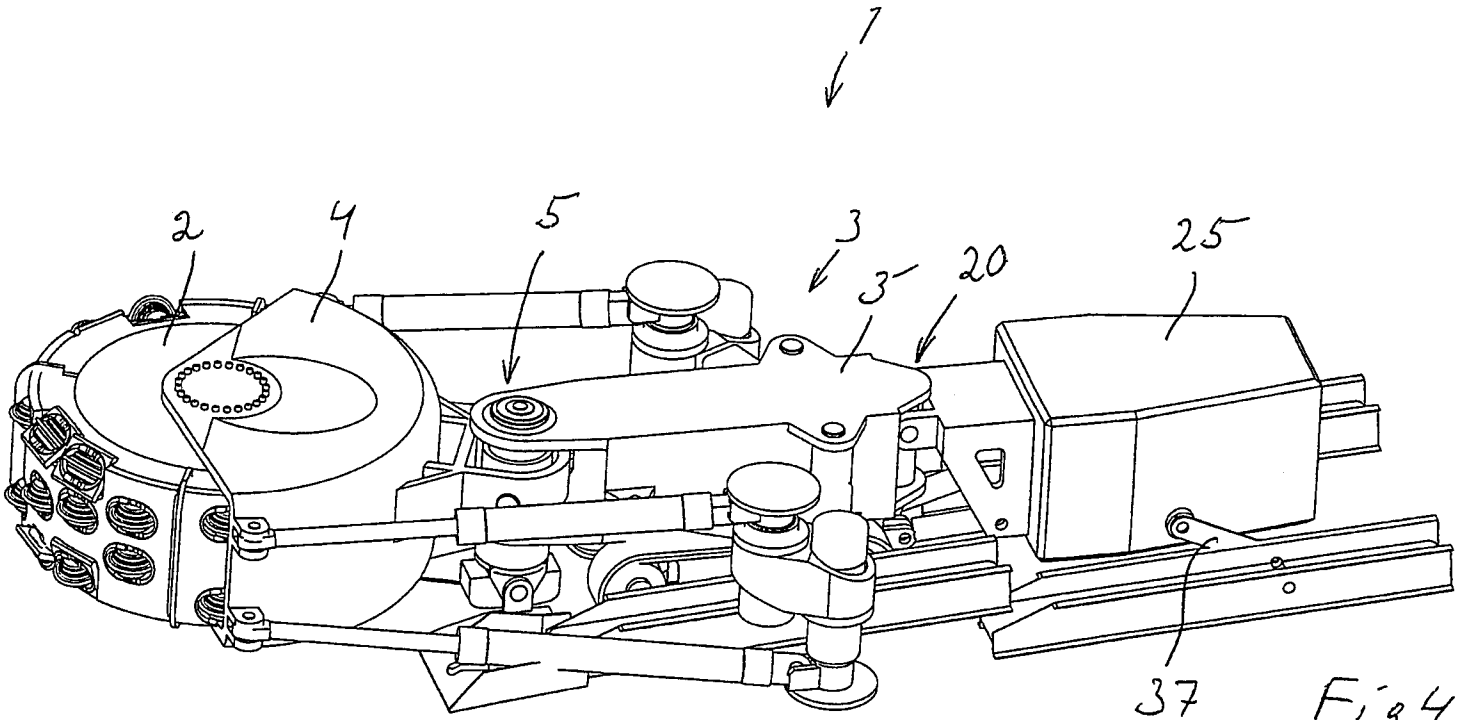

In FIG. 3, the device is shown with the support unit and thereby the cutting head being swung upwardly in respect of the base unit and in FIG. 4 the device is shown with the support unit and thereby the cutting head swung sidewardly in respect of the base unit.

It is to be understood that the cutting head can also be swung downwardly, in the opposite direction to what is shown in FIG. 3. The normal starting point for an excavation sequence (see below) is also with the cutting head swung downwardly in order to operate at the level corresponding to a floor for the device.

Figure 5:
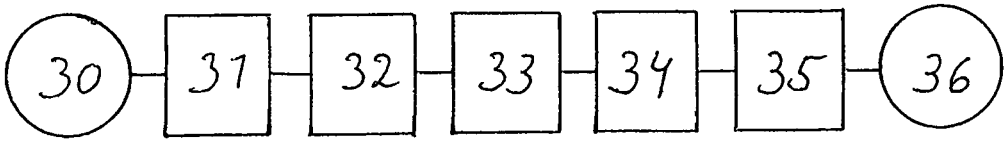
FIG. 5 shows diagrammatically a flowchart over a method sequence according to the invention.

A method sequence illustrated in FIG. 5 includes the following steps:

Position 30 indicates the start of the sequence and movement of the device 1 to a rock face to be excavated.

Position 31 indicates actuating and applying the stabilizing units.

Position 32 indicates starting rotation of the cutting head.

Position 33 indicates swinging the cutting head to a chosen vertical position and swinging the cutting head to a chosen sideward position.

Position 34 indicates driving forward the cutting head against the rock predetermined stroke length.

Position 35 indicates swinging sideways the cutting head during simultaneous excavation.

Position 36 indicates pulling back the cutting head after completed sideways stroke and terminating the sequence.

The sequence is thereupon repeated a desired number of times. Some sequence steps can be left out and others can be added, which is understood from the above description.

The invention can be modified within the scope of the following claims. Connection of the support unit is preferably to a front end of the base unit, but for example a more rearward position is not excluded.

It is not excluded that all excavation strokes are performed by forwarding according to position 34 and that excavation through swinging is left out even is this is normally not preferred.

The stabilizing units can be constructed otherwise than what is shown in the Figs., for example with axially directed jacks in case for example the stroke length requirements vis-á-vis minimum build height so allows.

As an example only of an inventive device, the following approximate data can be mentioned:

Rotational speed for cutting head: about 15 rpm
Excavating effect for the cutting head: 300-500 kW
Turning torque of the cutting head: 200 kNm
Pressing force acting, on the cutting head: 250 tons
Swing force acting on the cutting head: 50 tons
Diameter of cutting head: 2.0-3.0 m
Axial width of cutting head: 1.4-2.0 m

The invention claimed is:

1. Device (1) for driving tunnels, galleries or the like including:

a cutting head which is rotatable around a rotation axis (R) and which includes a plurality of cutting elements that are extending radially from a peripheral region of the cutting head and are distributed in a rotational direction as well as in an axial direction of said peripheral region, wherein an excavating direction of the cutting head (2) being essentially at a right angle to said rotation axis (R), a base unit (3) with stabilizing units (S1, S2, S3, S4) for applying and fixing against rock surfaces, a support unit (4) for the cutting head (2), a joint device (5) for pivotal connection of the support unit to the base unit, forcing means comprising a pair of upper fluid cylinders and a pair of lower fluid cylinders (6, 7, 8, 9) arranged between the base unit and the support unit for swinging the cutting head, wherein:

the joint device (5) is arranged for vertical as well as for horizontal swinging of the support unit (4) in respect of the base unit (3), wherein the support unit (4) is vertically as well as horizontally swingable and is able to be pressed in said excavating direction by said pair of upper fluid cylinders (6, 7) and said pair of lower fluid cylinders (8, 9), and the support unit (4) is supported by the base unit (3) in such a way that during vertical swinging, the rotation axis (R) is movable so as to be angled in a vertical symmetry plane extending through the support unit (4) and the joint device.

2. Device according to claim 1, wherein each pair of fluid cylinders includes a first fluid cylinder (6, 8) at a first side (10) of the base unit and a second fluid cylinder (7, 9) at a second side (11) of the base unit (3).

3. Device according to claim 2, wherein each one of said fluid cylinders (6, 7, 8, 9) at a first end is pivotally fastened to a stabilizing unit (S1, S2, S3, S4) and at a second end to said support unit (4).

4. Device according to claim 1, wherein each one of said fluid cylinders (6, 7, 8, 9) at a first end is pivotally fastened to one said stabilizing unit (S1, S2, S3, S4) and at a second end to said support unit (4).

5. Device according to claim 4, wherein the support unit (4) on each side of a position for connection with said joint device (5) includes fastening places (13, 15) for pivotal co-operation with second ends of said fluid cylinders (6, 7, 8, 9).

6. Device according to claim 5, wherein the stabilizing units (S1, S2, S3, S4) are moveably connected to a frame (3') of the base unit (3).

7. Device according to claim 4, wherein the stabilizing units (S1, S2, S3, S4) are moveably connected to a frame (3') of the base unit (3).

8. Device according to claim 7, wherein each stabilizing unit (S1, S2, S3, S4) is connected to said frame of the base unit (3) through a set of pivotal, length adjustable actuating means (16, 17, 18, 19).

9. Device according to claim 1, wherein the stabilizing units (S1, S2, S3, S4) include applying means for action upwardly against a roof as well as downwardly against a floor.

10. Device according to claim 1, wherein the base unit (3) essentially centrally, in the region of said joint device (5), includes stabilizing means (S5) for action upwardly against a roof and/or downwardly against a floor.

11. Device according to claim 1, wherein the support unit (4) is constructed in a fork-like manner for support of the cutting head (2).

12. Device according to claim 1, wherein the base unit (3) includes drive units (21) for forward and reverse propulsion.

13. Device according to claim 1, wherein the cutting head (2) includes cutting elements in the form of rotatable cutting disks.

14. Device according to claim 1, wherein the cutting head includes cutting elements in the form of cutting studs.

15. Method for driving tunnels, galleries or the like including:

rotating a cutting head (2) around a rotation axis (R), said cutting head having a plurality of cutting elements extending radially from a peripheral region of a cutting head, applying and fixing stabilizing units (S1, S2, S3, S4) being arranged at a base unit (3) against rock surfaces, pressing the cutting head (2) in an excavating direction essentially at a right angle to said rotation axis (R), swinging the cutting head over a joint device (5) for pivotal connection of a support unit (4) to a base unit (3), by forcing means comprising a pair of upper fluid cylinders and a pair of lower fluid cylinders (6, 7, 8, 9) being arranged between the base unit and the support unit, wherein the support unit (4) swings through the joint device (5) vertically as well as horizontally in respect of the base unit (3) and is pressed in said excavating direction with the aid of said pair of upper fluid cylinders (6, 7) and said pair of lower fluid cylinders (8, 9), and wherein, during vertical swinging, the rotation axis (R) is angled in a vertical symmetric plane through the joint device (5) and the support unit (4).

16. Method according to claim 15, wherein each one of said fluid cylinders (6, 7, 8, 9) is at a first end pivotally fastened to one said stabilizing unit (S1, S2, S3, S4) and at a second end to said support unit (4).

17. Method according to claim 16, wherein the stabilizing units (S1, S2, S3, S4) are displaced in respect of a frame (3') of the base unit (3).

18. Method according to claim 15, wherein the stabilizing units (S1, S2, S3, S4) are displaced in respect of a frame (3') of the base unit (3).

19. Method according to claim 18, wherein each stabilizing unit (S1, S2, S3, S4) is moved by means of a set of pivotal, length adjustable actuating means (16, 17, 18, 19).

20. Method according to claim 15, wherein the base unit (3) essentially centrally, in the region of said joint device (5), is stabilized through stabilizing means (S5) acting upwardly against a roof and/or downwardly against a floor.

* * * * *

UNITED STATES PATENT AND TRADEMARK OFFICE

CERTIFICATE OF CORRECTION

PATENT NO. : 9,212,552 B2
APPLICATION NO. : 13/261817
DATED : December 15, 2015
INVENTOR(S) : Sverker Hartwig et al.

It is certified that error appears in the above-identified patent and that said Letters Patent is hereby corrected as shown below:

In the Specification

Column 3, Line 39: Delete "FIG. 5", and substitute --FIG. 6--.

Signed and Sealed this
Sixteenth Day of February, 2016

Michelle K. Lee

Michelle K. Lee
*Director of the United States Patent and Trademark Office*